US006005947A

United States Patent [19]

Lim

[11] Patent Number: 6,005,947

[45] Date of Patent: Dec. 21, 1999

[54] TECHNIQUE FOR ENHANCING STEREO SOUND

[76] Inventor: Yong Ching Lim, Elec. Eng. Dept., National University of Singapore, Singapore, Singapore, 119260

[21] Appl. No.: 08/986,532

[22] Filed: Dec. 8, 1997

[51] Int. Cl.[6] ..... H04R 5/00

[52] U.S. Cl. ..... 381/17; 381/1

[58] Field of Search ..... 381/1, 18, 19, 381/17

[56] References Cited

U.S. PATENT DOCUMENTS

| | | | |
|---|---|---|---|
| 4,209,665 | 6/1980 | Iwahara . | |
| 4,355,203 | 10/1982 | Cohen . | |
| 4,980,914 | 12/1990 | Kunugi et al. | 381/1 |
| 5,440,638 | 8/1995 | Lowe et al. | 381/17 |

OTHER PUBLICATIONS

"Frequency Domain Modeling of Continuous time systems using the lattice algorithms" Lim et al. IEEE Transactions on Circuits & Systems, vol. CAS–36. No 3. pp. 429–433, Mar. 1989.

Y. C. Lim, "On the Synthsis of Lattice Parameter Digital Filters" IEEE Transactions on Circuits and Systems, vol. CAS–31, No 4. Jul. 1984. pp. 593–601.

Y. C. Lim, "On the Identification of Systems from Data Measurements using ARMA Lattice Models" IEEE Trans. on Acoustics, Speech & Signal Proc. vol. ASSp. 34, No. 4, Aug. 1986, p. 824–8.

*Primary Examiner*—Minsun Harvey

*Attorney, Agent, or Firm*—George O. Saile; Stephen B. Ackerman; Billy Knowles

[57] ABSTRACT

An acoustic signal processing subsystem for an electronic stereophonic audio system is disclosed. The acoustic signal processing subsystem will modify electronic audio signals such that sound broadcast from loudspeakers will be perceived as mimicking the quality of sound broadcast in an acoustically ideal room. The acoustic signal processing subsystem has a left signal processor coupled to a left acoustic signal source to modify the left acoustic signal and to couple a first modified left acoustic signal to a left speaker, and a right signal processor coupled to a right acoustic signal source to modify the right acoustic signal and to couple a first modified right acoustic signal to a right speaker. Further the acoustic signal processor has a left-right signal processor coupled to the left acoustic signal source to modify the left acoustic signal and to couple a first modified left acoustic signal to the right speaker, and a right-left signal processor coupled to the right acoustic signal source to modify the right acoustic signal and to couple a first modified right acoustic signal to the left speaker.

11 Claims, 2 Drawing Sheets

TECHNIQUE FOR ENHANCING STEREO SOUND

BACKGROUND OF THE INVENTION

1. Field Of The Invention

This invention relates to systems and circuits that will enhance the effect of stereo sound. More particularly this invention relates to a preprocessor that will modify the electrical signals of the stereo sound such that the sound broadcast from the speakers will mimic the characteristics of sound broadcast in an acoustically ideal room.

2. Description of Related Art

Stereo sound imaging perceived by a listener using a traditional two-channel stereo sound reproduction system depends on the acoustic properties of the listening environment, i.e. the acoustic properties of the room. Although the most direct way for improving the perceived sound imaging is to improve the acoustic properties of the room, i.e. to alter the geometry of the room, ceiling heights, wall separations, angles of tilts for ceilings and walls, and the acoustic properties of the materials used, such an approach is definitely costly. An alternative approach is to place an electronic preprocessor before the speakers to preprocess the signals delivered to the speakers so that the signals perceived by the listener(s) mimics as closely as possible the signals perceived in an ideal acoustic room.

Consider a scenario comprising of an acoustic radiator and a sensor in an enclosed room as shown in FIG. 1. Acoustic waves radiated from the radiator propagate to the sensor through a multipath channel. The followings are some examples of the paths. Path #1 is the direct path. Path #2 is a single reflection path. Path #3 and path #4 are multiple reflection paths.

The transmission characteristics from the signal source to the sensor may be described by the Laplace transform transfer function, H(s), given by $$H(s) = \frac{\sum_{n=0}^{N} a_n s^n}{\sum_{n=0}^{N} b_n s^n}$$

where:

N is the order of the transfer function.

H(s) may be obtained from the autocorrelation and cross correlation functions of the signal radiated from the radiator and the signal received by the sensor.

A listener in a room with two speakers as shown in FIG. 2 is an example of a two-radiator two-sensor system. In FIG. 2, the two speakers are the two radiators and the two ears of the listener are the two sensors. The transmission characteristics from the right speaker Speaker-R to the left ear Ear-L and the right ear Ear-R may be represented by the transfer function $H_{RL}(s)$ and $H_{RR}(s)$, respectively. Similarly, the transmission characteristics from the left speaker Speaker-L to the left ear Ear-L and the right ear Ear-R may be represented by the transfer function $H_{LL}(s)$ and $H_{LR}(s)$, respectively.

U.S. Pat. No. 5,440,638 (Lowe et al.) describes a preprocessor to enhance the sound field in a stereo reproduction system. A portion of the audio information that is common or substantially common to both the left and right stereo input signals is removed. The remaining components are processed in left and right sound placement filters. The outputs of the left and right placement filters are then added respectively to the right and left stereo input signals. This will produce an enhanced sound field at the stereo outputs. The input signal not processed will be delayed to maintain coherency.

U.S. Pat. No. 4,980,914 (Kunugi et al.) discloses a sound field correcting system. The sound field correcting system will correct multipath frequency characteristic distortion in an acoustic reproduction system. The level and delay of an original signal are adjusted and superposed on the original signal so as to obtain a signal which, when reproduced by a loudspeaker, yields a sound pattern at a listening point having a flat frequency characteristic. The delay adjustment is effected in accordance with a difference between the travel distances of direct and reflected sound waves to the listening point.

U.S. Pat. No. 4,355,203 (Cohen) describes a stereo enhancement system that utilizes a difference signal. The difference signal is derived from the left and right stereo channels in which the difference signal is delayed, amplified, and then added into the appropriate channels to cancel left/right speaker mixing at the listeners ear. This is to improve stereo separation without center region distortion.

U.S. Pat. No. 4,209,665 (Iwahara) discloses a signal translator that include right- and left-channel translating networks. The right- and left-channel translating networks are constructed to have a transfer function:

$$\frac{1}{A+B}$$

where:

A is the transfer function of the direct acoustic path between a right-channel sound source and a listener's ear.

B is the transfer function of the direct acoustic path between a left-channel sound source and listener's ear.

Through the right- and left-channel components of spatially correlated audio signals under go transformation of:

$$\frac{1}{A+B}$$

When binaural signals are applied to the translating networks, the translated output signals are applied to a pair of loudspeakers in a listening room. The acoustic direct paths and crosstalk paths transform the signal so that the impinging sound at the listener's ear is distortion free.

SUMMARY OF THE INVENTION

An object of this invention is to provide an acoustic processing subsystem for an electronic stereophonic audio system that will modify electronic audio signals such that sound broadcast from loudspeakers will be perceived as mimicking the quality of sound broadcast in an acoustically ideal room.

To accomplish these and other objects, an acoustic signal processor has a left signal processor coupled to a left acoustic signal source to modify the left acoustic signal and to couple a first modified left acoustic signal to a left speaker, and a right signal processor coupled to a right acoustic signal source to modify the right acoustic signal and to couple a first modified right acoustic signal to a right speaker. Further the acoustic signal processor has a left-right signal processor coupled to the left acoustic signal source to modify the left acoustic signal and to couple a first modified left acoustic signal to the right speaker, and a right-left signal processor coupled to the right acoustic signal source to modify the right acoustic signal and to couple a first modified right acoustic signal to the left speaker.

DETAILED DESCRIPTION OF THE INVENTION

Figure 1:
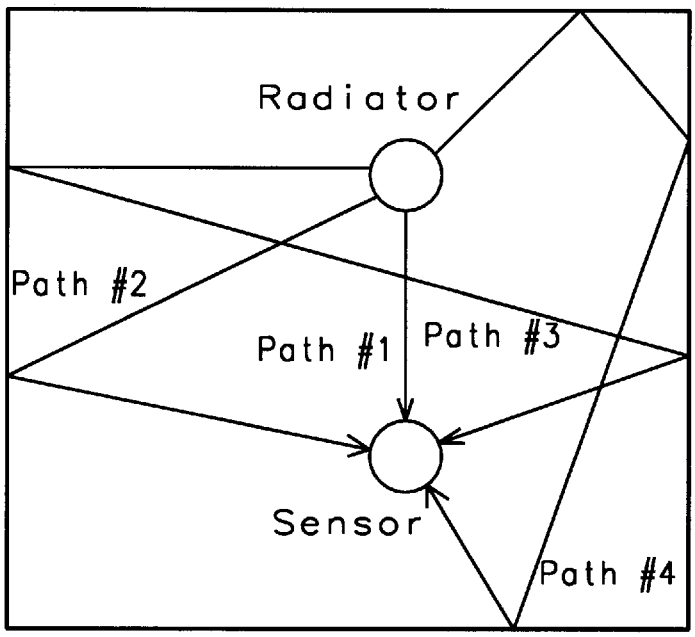
FIG. 1 shows a diagram of an acoustic radiator and a sensor.
Figure 2:
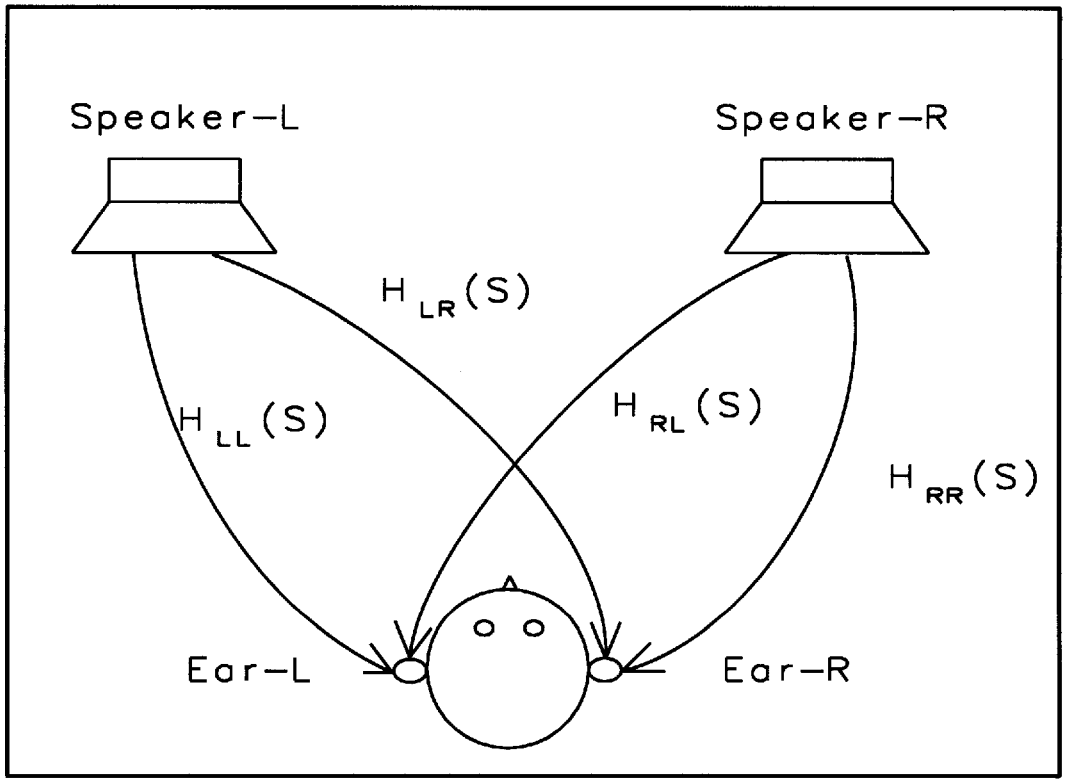
FIG. 2 shows a diagram of a listener and two speakers in a room.

Referring back to FIG. 2, the autocorrelation and cross-correlation functions can be obtained using the functions of "Frequency domain modeling of continuous time systems using the lattice algorithms," Lim Y. C. and S. R. Parker, IEEE Transactions on Circuits and Systems, vol. CAS-36, no.3, pp.429–433, March 1989, herein incorporated by reference. Similarly, the transmission characteristics from the left speaker Speaker-L to the left ear Ear-L and the right ear Ear-R may be represented by the transfer function $H_{LL}(s)$ and $H_{RL}(s)$, respectively. Similarly, the transmission characteristics from the right speaker Speaker-R to the left ear Ear-L and the right ear Ear-R may be represented by the transfer function $H_{RL}(s)$ and $H_{RR}(s)$, respectively. The transfer functions $H_{LL}(s)$, $H_{LR}(s)$, $H_{RL}(s)$, and $H_{RR}(s)$ may be determined individually using the method reported in reference Lim and Parker.

Figure 3:
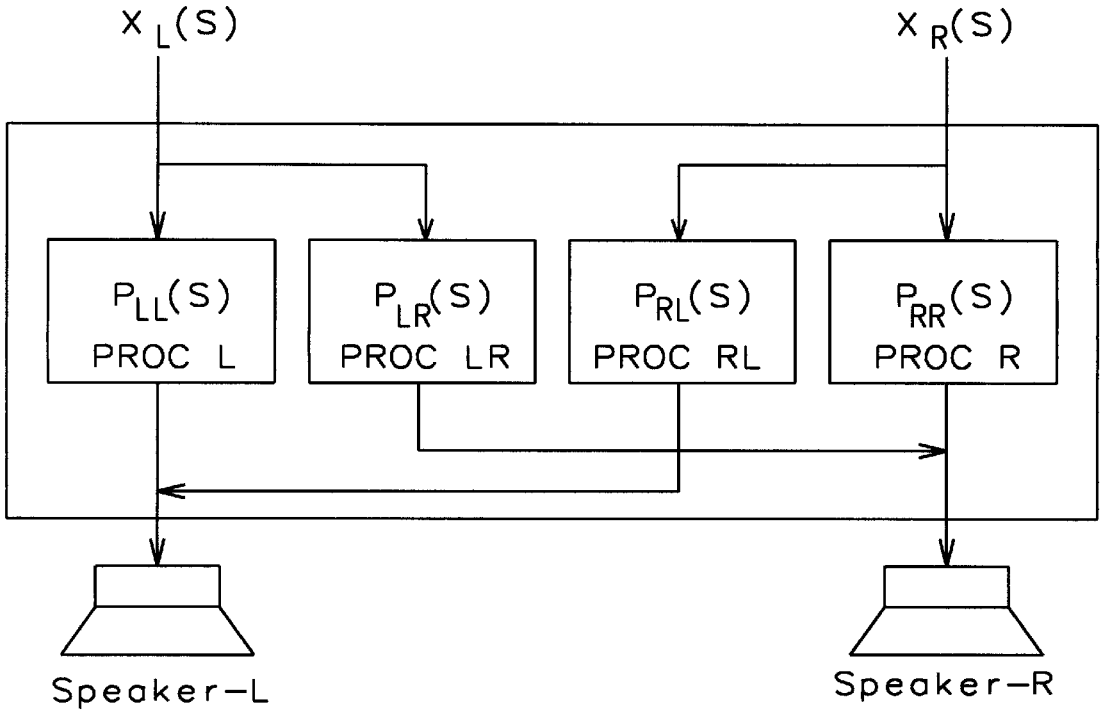
FIG. 3 is a block diagram of four signal processors structure to modify the stereo signals from the left and right stereo channels before being delivered to the speakers of this invention.

Let the Laplace transforms of the left- and right-channel signals be XL(s) and XR(s), respectively. Let the processor Laplace transform transfer function of the left processor ProcL from the left-channel signal XL (s) to the left speaker Speaker-L and of the right processor ProcR from the right-channel signal XR(s) to the right speaker Speaker-R be $P_{LL}(s)$ and $P_{LR}(s)$, respectively. Let the processor Laplace transform transfer function for processor ProcRL from the right-channel signal XR(s) to the left speaker Speaker-L and for ProcLR from the left-channel signal XL(s) to right speaker Speaker-R be $P_{RL}(s)$and $P_{RR}(s)$, respectively. Refer now to FIG. 3. The signal received by the left ear Ear-L denoted by $Y_L(s)$ is given by $$Y_L(s)=[P_{LL}(S)H_{LL}(s)+P_{LR}(s)H_{RL}(s)]X_L(s)+[P_{RL}(s)H_{LL}(s)+P_{RR}(s)H_{RL}(s)]X_R(s) \quad (1)$$

The signal received by the right Ear-R denoted by $Y_R(s)$ is given by $$Y_R(s)=[P_{LL}(s)H_{LR}(s)+P_{LR}(s)H_{RR}(s)]X_L(s)+[P_{RL}(s)H_{LR}(s)+P_{RR}(s)H_{RR}(s)]X_R(s) \quad (2)$$

Suppose that an ideal acoustic room has transfer functions. $H_{LL}(s)$, $H_{LR}(s)$, $H_{RL}(s)$, and $H_{RR}(s)$ that are given by $\bar{H}_{LL}(s)$, $\bar{H}_{LR}(s)$, $\bar{H}_{RL}(s)$, and $\bar{H}_{RR}(s)$ respectively. In such an ideal acoustic room, the preprocessor is not necessary. The received signals $Y_L(s)$ and $Y_R(s)$ are given by $$Y_L(s)=\bar{H}_{LL}(s)X_L(s)+\bar{H}_{RL}(s)X_R(s) \quad (3)$$

$$Y_R(s)=\bar{H}_{LR}(s)X_L(s)+\bar{H}_{RR}(s)X_R(s) \quad (4)$$

So to derive the transfer characteristics of the ideal acoustic room $\bar{H}_{LL}(s)$ and $\bar{H}_{RL}(s)$ the equations (1) and (3) are compared:

$$P_{LL}(s)H_{LL}(s)+P_{LR}(s)H_{RL}(s)=\bar{H}_{LL}(s) \quad (5)$$

$$P_{RL}(s)H_{LL}(s)+P_{RR}(s)H_{RL}(s)=\bar{H}_{RL}(s) \quad (6)$$

Similarly, equations (2) and (4) are compared to yield:

$$P_{LL}(s)H_{LR}(s)+P_{LR}(s)H_{RR}(s)=\bar{H}_{LR}(s) \quad (7)$$

$$P_{RL}(s)H_{LR}(s)+P_{RR}(s)H_{RR}(s)=\bar{H}_{RR}(s) \quad (8)$$

Solving equations (5), (6), (7), and (8) will lead to solutions for the processor transfer functions $P_{LL}(s)$, $P_{LR}(s)$, $P_{RL}(s)$, and $P_{RR}(s)$. In order to reduce the implementation cost a reduced order model is obtained for the processor transfer functions $P_{LL}(s)$, $P_{LR}(s)$, $P_{RL}(s)$, and $P_{RR}(s)$. The values of the transfer functions $\bar{H}_{LL}(s)$, $\bar{H}_{LR}(s)$, $\bar{H}_{RL}(s)$, $\bar{H}_{RR}(s)$, $H_{LL}(s)$, $H_{LR}(s)$, $H_{RL}(s)$, and $H_{RR}(s)$ are evaluated on dense value of $$s=j\Omega.$$

The parameters of the processor transfer functions $P_{LL}(s)$, $P_{LR}(s)$, $P_{RL}(s)$, and $P_{RR}(s)$ are then estimated using a least squares technique that is well known in the art.

Figure 4:
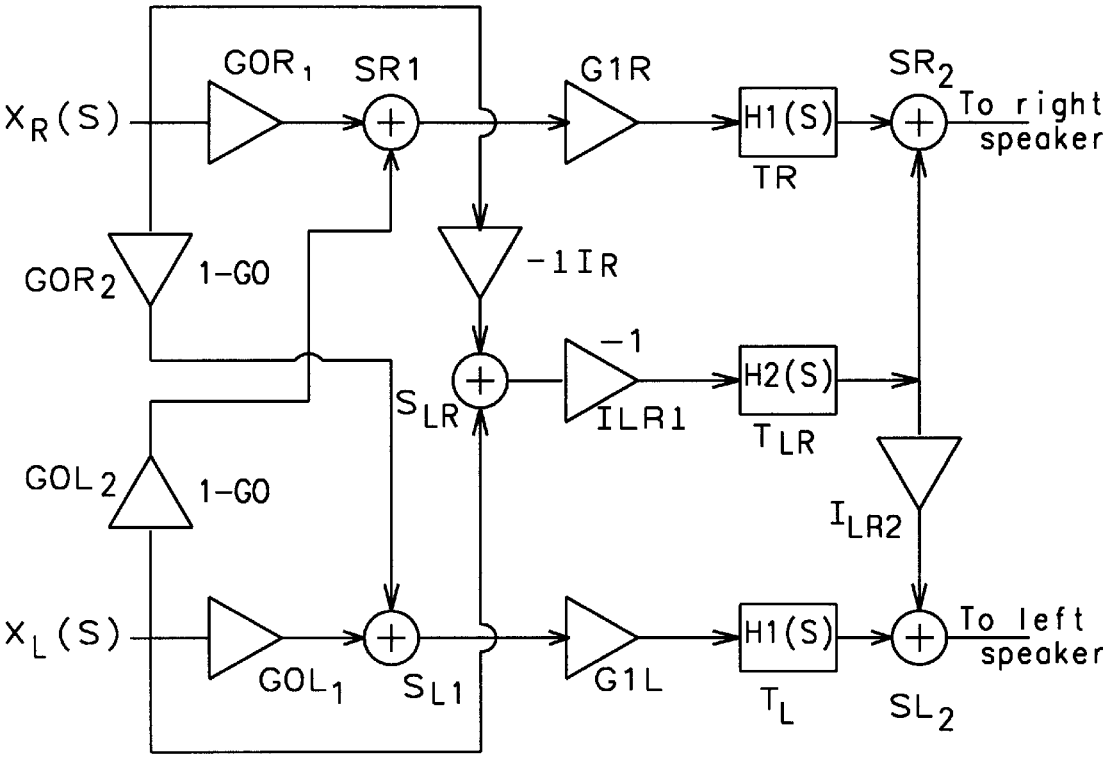
FIG. 4 shows the circuit diagram of the processors of this invention.

An embodiment of the preprocessing elements is shown in FIG. 4. The left processing element ProcL of FIG. 3 will be formed by the gain elements $G_{oL1}$, $G_{1L}$, $G_{0R2}$, the summing element $S_{L1}$, and the transform element $T_L$. The right processing element ProcR of FIG. 3 will be formed by the gain elements $G_{oR1}$, $G_{1R}$, $G_{0L2}$, the summing element $S_{R1}$, and the transform element $T_R$. The right-left processing element ProcRL of FIG. 3 will be formed by the summing element $S_{LR}$, inversion elements $I_R$, $I_{LR1}$, and $I_{LR2}$ and the transform element $T_{LR}$. The left-right processing element ProcLR of FIG. 3 will be formed by the summing element $S_{LR}$, inversion element $I_R$ and $I_{LR1}$, and the transform element $T_{LR}$.

The summing node $S_{L2}$ will combine the output of the transform element $T_L$ and the output of the inversion element $I_{LR2}$ to form the modified electrical acoustical signal that will be the input to the left loudspeaker SpeakerL of FIG. 3. The summing node $S_{R2}$ will combine the output of the transform element $T_R$ and the transform element $T_{LR}$ to form the modified electrical acoustical signal that will be the input to the right loudspeaker SpeakerR of FIG. 3.

It is observed that $P_{LL}(s)$ and $P_{RR}(s)$ are approximately equal to a scaled version of $H_1(s)$ plus a scaled version of $H_2(s)$. The synthesis structure of FIG. 4 is thus developed. This produces reference values for $\tau_1$ and $\tau_2$ in $H_1(s)$ and $H_2(s)$.

The Laplace transform $H_1(s)$ of the transform elements $T_L$ and $T_R$ is:

$$H_1 = \frac{1+2\tau_1}{1+3\tau_1}$$

Where:

$\tau_1$ is a first time constant within the left and right signal processor.

The Laplace transform $H_2(s)$ of the transform elements $T_{LR}$ is:

$$H_2 = \frac{3 + 6\tau_2 s}{1 + 8\tau_2 s}$$

Where:

$\tau_2$ is a time constant within the left-right transform element.

The gain elements $G_{OL1}$ and $G_{OR1}$ have gains $G_O$ between approximately 0.5 and approximately 1. And the gain elements $G_{OL2}$ and $G_{OR2}$ have gains $(1-G_O)$ between approaching 0 and approximately 0.5.

Because of the large number of approximations used in the derivation of the reference values for $\tau_1$ and $\tau_2$, the original reference values of $\tau_1$ and $\tau_2$ do not give the most pleasing listening pleasure. They are fine tuned experimentally. It has been found that the time constants $\tau_1$ and $\tau_2$ will have values as follows:

$\tau_1$=approximately 70 $\mu$sec. and $\tau_2$=approximately 60 $\mu$sec. or $\tau_1$=approximately 35 $\mu$sec. and $\tau_2$=approximately 40 $\mu$sec.

The left processor ProcL, the right processor ProcR, the left-right processor ProcLR, and the right-left processor ProcRL can be implemented as an active or passive filtering circuits placed at the output of the stereo amplification circuits within a stereophonic audio system. Or the left processor ProcL, the right processor ProcR, the left-right processor ProcLR, and the right-left processor ProcRL can be implemented within as a program within a real time digital signal processor prior to the amplification circuits necessary to drive the left and right loudspeakers SpeakerL and SpeakerR of FIG. 3.

While this invention has been particularly shown and described with reference to the preferred embodiments thereof, it will be understood by those skilled in the art that various changes in form and details may be made without departing from the spirit and scope of the invention.

The invention claimed is:

1. An electronic stereophonic audio system that will compensate for acoustic properties of a room such that said room will mimic an acoustically ideal room, comprising:

a) a left acoustic signal source to provide a left acoustic signal;

b) a right acoustic signal source to provide a right acoustic signal;

c) a left speaker to provide a left sound signal to said room;

d) a right speaker to provide a right sound signal to said room;

e) a left signal processor coupled to the left acoustic signal source to modify the left acoustic signal and to couple a first modified left acoustic signal to said left speaker, whereby said left signal processor modifies said left acoustic signal by the following function:

$$P_{LL}=[G_O X_L+(1-G_O)X_R]G_1 H_1$$

where:

$P_{LL}$ is an output signal of said left signal processor,
$G_O$ is a first gain factor,
$X_L$ is the left acoustic signal,
$X_R$ is the right acoustic signal,
$G_1$ is a second gain factor,
$H_1$ is a Laplace transform given by:

$$H_1 = \frac{1 + 2\tau_1 S}{1 + 3\tau_2 S}$$

$\tau_1$ is a first time constant within said left signal processor;

f) a right signal processor coupled to the right acoustic signal source to modify the right acoustic signal and to couple a first modified right acoustic signal to said right speaker, whereby said right signal processor modifies said right acoustic signal by the following function:

$$P_{RR}=[G_O X_R+(1-G_O)X_L]G_1 H_1$$

where:

$P_{RR}$ is an output signal of said right signal processor,
$G_O$ is a first gain factor,
$X_R$ is the right acoustic signal,
$X_L$ is the left acoustic signal,
$G_1$ is a second gain factor,
$H_1$ is a Laplace transform given by:

$$H_1 = \frac{1 + 2\tau_1 S}{1 + 3\tau_2 S}$$

$\tau_1$ is a first time constant within said right signal processor;

g) a left-right signal processor coupled to the left acoustic signal source to modify the left acoustic signal and to couple a first modified left acoustic signal to said right speaker, whereby said left-right signal processor modifies said left acoustic signal by the following function:

$$P_{LR}=[-(X_L-X_R)]H_2$$

where:

$P_{LR}$ is an output signal of said left-right signal processor,
$X_L$ is the left acoustic signal,
$X_R$ is the right acoustic signal,
$H_2$ is a Laplace transform given by:

$$H_2 = \frac{3 + 6\tau_2 s}{1 + 8\tau_2 s}$$

$\tau_2$ is a second time constant within said left-right signal processor; and h) a right-left signal processor coupled to the right acoustic signal source to modify the right acoustic signal and to couple a first modified right acoustic signal to said left speaker, whereby said right-left signal processor modifies said right acoustic signal by the following function:

$$P_{RL}=-[-(X_L-X_R)]H_2$$

where:

$P_{RL}$ is an output signal of said left-right signal processor,
$X_R$ is the right acoustic signal,
$X_L$ is the left acoustic signal, $H_2$ is a Laplace transform given by:

$$H_2 = \frac{3 + 6\tau_2 s}{1 + 8\tau_2 s}$$

$\tau_2$ is the second time constant within said right-left signal processor.

2. The audio system of claim 1 wherein the first time constants within the left and right signal processors have a value of approximately 70 μsec. and the second time constants within the left-right and right-left signal processors have a value of approximately 60 μsec.

3. The audio system of claim 1 wherein the first time constants within the left and right signal processors have a value of approximately 35 μsec. and the second time constants within the left-right and right-left signal processors have a value of approximately 40 μsec.

4. The audio system of claim 1 wherein the left signal processor comprises:

a) a first and second gain element each having an input coupled respectively to said left signal source and said right signal source to amplify respectively said left and right signals;

b) a first summing node having a first input coupled to the first gain element, a second input coupled to the second gain element;

c) a third gain element having an input coupled to an output of the first summing node to amplify said output of said first summing node; and d) a first transform element having an input coupled to an output of said fifth gain element whereby said first transform elements modifies said input by the function:

$$H_1 = \frac{1 + 2\tau_1 S}{1 + 3\tau_2 S}$$

$\tau_1$ is a first time constant within said first transform element.

5. The audio system of claim 1 wherein the right signal processor comprises:

a) a fourth and fifth gain element each having an input coupled respectively to said right signal source and said left signal source to amplify respectively said right and left signals;

b) a second summing node having a first input coupled to the third gain element, a second input coupled to the fourth gain element;

c) a sixth gain element having an input coupled to an output of the second summing node to amplify said output of said second summing node; and d) a second transform element having an input coupled to an output of said sixth gain element whereby said second transform elements modifies said input by the function:

$$H_1 = \frac{1 + 2\tau_1 S}{1 + 3\tau_2 S}$$

$\tau_1$ is a first time constant within said second transform element.

6. The audio system of claim 1 wherein the left-right signal processor comprises:

a) a first inversion element having an input coupled to the right signal source to provide a phase inverted form of the right signal;

b) a third summing node having a first input coupled to the left signal source and a second input coupled to an output of the first inversion element;

c) a second inversion element having an input coupled to an output of the third summing node to provide a phase inverted form of said output of said third summing node; and d) a third transform element having an input coupled to an output of said second inversion element whereby said third transform elements modifies said input by the function:

$$H_2 = \frac{3 + 6\tau_2 s}{1 + 8\tau_2 s}$$

$\tau_2$ is a time constant within said third transform element.

7. The audio system of claim 1 wherein the right-left signal processor comprises:

a) the first inversion element having an input coupled to the right signal source to provide a phase inverted form of the right signal;

b) the third summing node having a first input coupled to the left signal source and a second input coupled to an output of the first inversion element;

c) the second inversion element having an input coupled to an output of the third summing node to provide a phase inverted form of said output of said third summing node;

d) the third transform element having an input coupled to an output of said second inversion element whereby said third transform elements modifies said input by the function:

$$H_2 = \frac{3 + 6\tau_2 s}{1 + 8\tau_2 s}$$

$\tau_2$ is a time constant within said third transform element; and e) a third inversion element having an input coupled to an output of said third transform element to provide a phase inverted form of said output of said third transform element.

8. The audio system of claim 1 further comprising:

a) a fourth summing node having a first input coupled to an output of said first transform element and a second input coupled to an output of said third inversion element, whereby an output of said fourth summing node combines the outputs of the first transform element and the phase inverted form of the output of said third transform element to form the left sound signal; and b) a fifth summing node having a first input coupled to an output of said second transform element and a second input coupled to an output of said third transform element, whereby an output of said fourth summing node combines the outputs of the second and third transform elements to form the right sound signal.

9. A signal processor coupled to a left signal source and right signal source to modify a left signal from a left signal source and right signal from a right signal source, and to transmit a left modified signal to a left radiator and a right modified signal to a right radiator, comprising:

a) a first and second gain element each having an input coupled respectively to said left signal source and said right signal source to amplify respectively said left and right signals;

b) a third and fourth gain element each having an input coupled respectively to said right signal source and said left signal source to amplify respectively said right and left signals;

c) a first summing node having a first input coupled to the first gain element, a second input coupled to the second gain element;

d) a second summing node having a first input coupled to the third gain element, a second input coupled to the fourth gain element;

e) a first inversion element having an input coupled to the right signal source to provide a phase inverted form of the right signal;

f) a third summing node having a first input coupled to the left signal source and a second input coupled to an output of the first inversion element;

g) a fifth gain element having an input coupled to an output of the first summing node to amplify said output of said first summing node;

h) a sixth gain element having an input coupled to an output of the second summing node to amplify said output of said second summing node;

i) a second inversion element having an input coupled to an output of the third summing node to provide a phase inverted form of said output of said third summing node;

j) a first transform element having an input coupled to an output of said fifth gain element whereby said first transform elements modifies said input by the function:

$$H_1 = \frac{1 + 2\tau_1 S}{1 + 3\tau_2 S}$$

$\tau_1$ is a first time constant within said first transform element;

k) a second transform element having an input coupled to an output of said sixth gain element whereby said second transform elements modifies said input by the function:

$$H_1 = \frac{1 + 2\tau_1 S}{1 + 3\tau_2 S}$$

$\tau_1$ is a first time constant within said second transform element;

l) a third transform element having an input coupled to an output of said second inversion element whereby said third transform elements modifies said input by the function:

$$H_2 = \frac{3 + 6\tau_2 s}{1 + 8\tau_2 s}$$

$\tau_2$ is a time constant within said third transform element;

m) a third inversion element having an input coupled to an output of said third transform element to provide a phase inverted form of said output of said third transform element;

n) a fourth summing node having a first input coupled to an output of said first transform element and a second input coupled to an output of said third inversion element, whereby an output of said fourth summing node combines the outputs of the first transform element and the phase inverted form of the output of said third transform element to form the left modified signal; and o) a fifth summing node having a first input coupled to an output of said second transform element and a second input coupled to an output of said third transform element, whereby an output of said fourth summing node combines the outputs of the second and third transform elements to form the right modified signal.

10. The signal processor of claim 9 wherein the first time constants within the left and right signal processors have a value of approximately 70 $\mu$sec. and the second time constants within the left-right and right-left signal processors have a value of approximately 60 $\mu$sec.

11. The signal processor of claim 9 wherein the first time constants within the left and right signal processors have a value of approximately 35 $\mu$sec. and the second time constants within the left-right and right-left signal processors have a value of approximately 40 $\mu$sec.

* * * * *